United States Patent [19]

Vitale

[11] Patent Number: 4,576,315

[45] Date of Patent: Mar. 18, 1986

[54] SAFETY CLOSURE FOR AEROSOL CANS

[76] Inventor: Ralph A. Vitale, P.O. Box 15736, Sarasota, Fla. 33579

[21] Appl. No.: 609,512

[22] Filed: May 10, 1984

[51] Int. Cl.[4] ..... B67D 5/32; B67D 5/06

[52] U.S. Cl. ..... 222/153; 222/182; 222/402.11; 220/85 P; 411/417; 411/395

[58] Field of Search ..... 222/153, 182, 402.11, 222/402.12; 220/85 P, 281, 288; 403/320, 104; 411/383, 385, 395, 417, 418, 419

[56] References Cited

U.S. PATENT DOCUMENTS

| | | | |
|---|---|---|---|
| 437,062 | 9/1890 | Tyler | 411/419 |
| 746,466 | 12/1903 | Cornell | 403/320 |
| 2,560,211 | 7/1951 | Burdick | 411/383 |
| 3,341,044 | 9/1967 | Valk | 215/220 |
| 3,349,969 | 10/1967 | Velt . | |
| 3,462,045 | 8/1969 | Markowitz | 222/153 |
| 3,724,724 | 4/1973 | Guch | 222/153 |
| 3,782,605 | 1/1974 | Messenger . | |
| 3,857,505 | 12/1974 | Momford et al. | 215/220 |
| 3,863,814 | 2/1975 | Shelton . | |
| 3,892,326 | 7/1975 | Schneible . | |
| 4,024,988 | 5/1977 | Starrett . | |
| 4,130,220 | 12/1978 | McKirnan . | |
| 4,303,175 | 12/1981 | Lux | 222/153 |
| 4,353,483 | 10/1982 | Pehr . | |
| 4,457,445 | 7/1984 | Hanks et al. | 222/182 |

*Primary Examiner*—Joseph J. Rolla
*Assistant Examiner*—Andrew Jones
*Attorney, Agent, or Firm*—Roylance, Abrams, Berdo & Goodman

[57] ABSTRACT

A safety closure of an aerosol can comprises an externally screw threaded sleeve having a slit extending along one side thereof and an inwardly extending flange at its lower end. The flange is engageable below an upper peripheral rim of the aerosol can after the sleeve has been temporarily flexed apart along its slit to enable the flange to pass over the rim. An internally screw threaded safety cap threadedly engages over the threaded sleeve and prevents the sleeve from flexing apart along the slit so locking the flange under the rim. The safety cap can only be unscrewed from the sleeve if the cap is additionally pressed firmly downwards. Advantageously the safety cap is of a type used as a childproof closure for medicines.

16 Claims, 6 Drawing Figures

SAFETY CLOSURE FOR AEROSOL CANS

FIELD OF THE INVENTION

This invention relates to safety closures for aerosol cans, and to aerosol cans provided with such, to prevent or hinder inadvertent or unauthorized operation of the aerosol cans by children.

BACKGROUND OF THE INVENTION

Aerosol cans are well known for dispensing many products such as, for example, shaving cream, perfume, antiperspirants, insecticides, paint etc. Some of these products are dangerous to children, and some are damaging to clothes, furniture etc. if inadvertently dispensed thereon.

Child resistant closures for different types of containers, particularly medicine containers, are well known. Some of these are now inexpensive to manufacture and have obtained credibility with adults.

Many attempts have been made over the years to provide child resistant closures for aerosol cans, examples of such being disclosed in U.S. Pat. Nos. 3,349,969; 3,863,814; 4,130,220 and 4,353,483. However, there is still a need for a low cost child resistant closure for an aerosol can which is easy to operate by adults and has credibility with adults.

SUMMARY OF THE INVENTION

It is an object of the present invention to provide an improved safety closure for an aerosol can.

A feature by which this is achieved is the employment of a slit sleeve which can be snapped over the conventional peripheral rim of the aerosol can, and then a safety cap screwed onto this sleeve. This has the advantage of enabling medicine type safety caps to be used with aerosol cans, thus providing both credibility and low cost.

Accordingly, therefore, there is provided by the present invention a safety closure for an aerosol can having a conventional peripheral rim, comprising a sleeve having top and bottom openings with a slit extending along one side of the sleeve between these openings. The sleeve has externally thereon a screw thread, and has an inwardly extending flange at the bottom defining said bottom opening, whereby the flange can engage below the peripheral rim of the aerosol can after the sleeve has been flexed apart along its slit to enable the flange to pass over the aerosol's rim. A safety cap having an internal screw thread is screwed onto the sleeve to prevent the sleeve from flexing apart along its slit and so lock the flange under the aerosol's rim. The safety cap includes means for preventing the cap from being simply unscrewed from the sleeve without performing an additional safety operation.

Preferably, the safety cap is of the type used with medicine containers and requiring the cap to be pushed firmly downwards before it will unscrew.

Other objects, features and advantages of the present invention will become more fully apparent from the following detailed description of the preferred embodiment, the appended claims and the accompanying drawings.

DETAILED DESCRIPTION OF THE PREFERRED EMBODIMENT

The preferred embodiment of the invention is illustrated in FIGS. 1 to 6.

Figure 1:
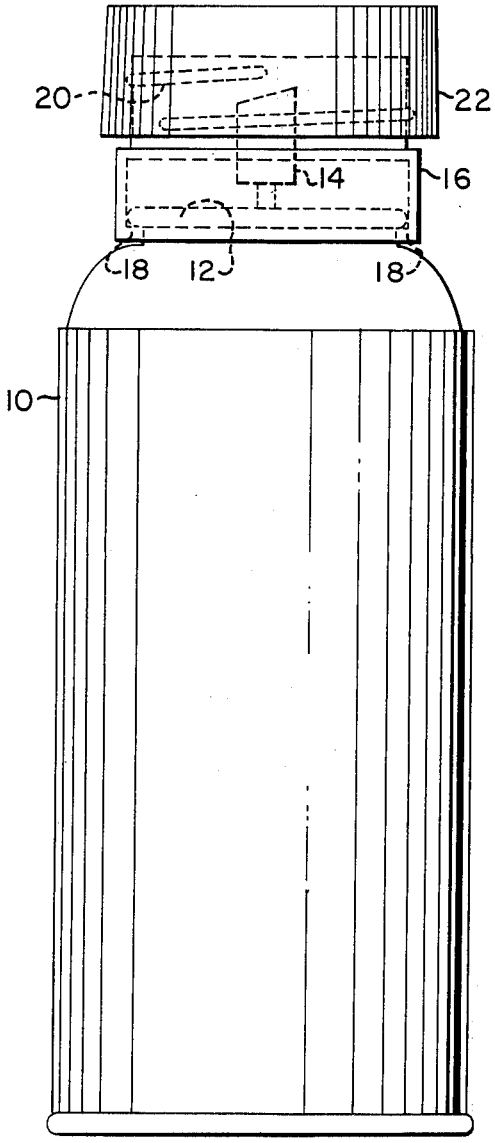
FIG. 1 is an elevational view of an aerosol can provided with a safety closure according to the present invention.

FIG. 1 shows a conventional aerosol can 10 having a top peripheral rim 12 (in broken lines) and a dispensing valve member 14 (in broken lines) extending upwardly above the rim 12. A sleeve 16 has a flange 18 (in broken lines) at the bottom engaging below the rim 12. The upper portion of the sleeve 16 has an external screw thread 20 (in broken lines) on which is screwed a safety cap 22.

Figure 2:
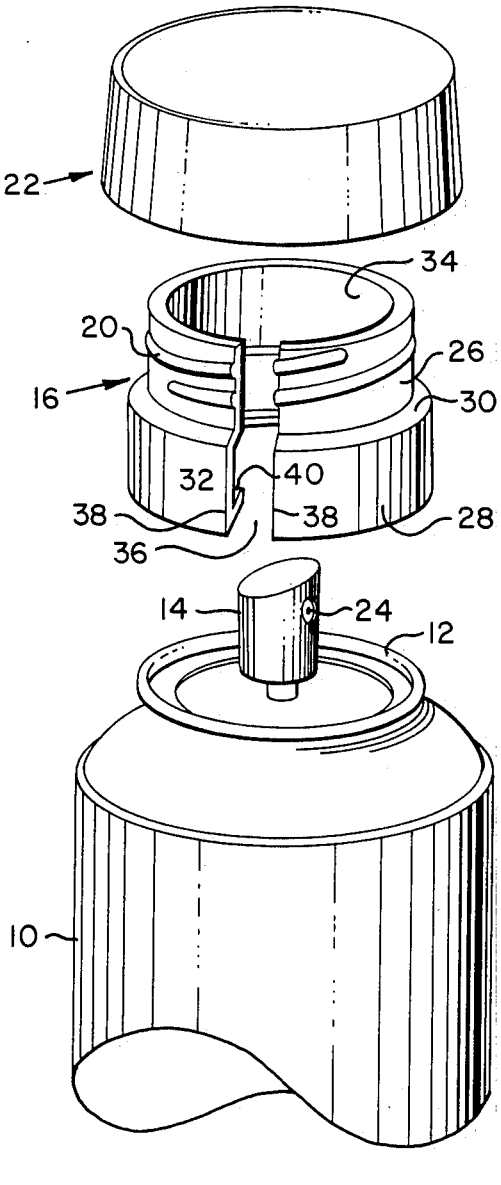
FIG. 2 is an exploded view of the cap, sleeve and aerosol can of FIG. 1.

FIG. 2 shows in exploded view the upper portion of the aerosol can 10, the sleeve 16 and the cap 22. The valve member 14 is disposed centrally of the rim 12 and has an orifice 24 through which an aerosol spray is dispensed by depressing or deflecting the valve member 14. The sleeve 16 is of generally cylindrical shape and has a smaller diameter upper portion 26 integrally connected to a larger diameter lower portion 28 by a frusto-conical section 30. The screw thread 20 on the exterior of the upper portion 26 is interrupted by a vertical slit 32 extending down one side of the sleeve 16 from the top opening 34 thereof to the bottom opening 36 thereof, the slit 32 extending continuously through the upper cylindrical portion 26, the frusto-conical section 30 and the lower cylindrical portion 28. The width of the slit 32 is shown exaggerated for clarity. The sleeve is injection molded from thermoplastic material, and is sufficiently resilient to allow the slit 32 to be flexed apart to increase the size of the openings 34, 36, but normally to close the slit so that the longitudinal edges 38 thereof are closely adjacent. Extending radially inwardly from the lower edge of the sleeve is a flange 40.

Figure 3:
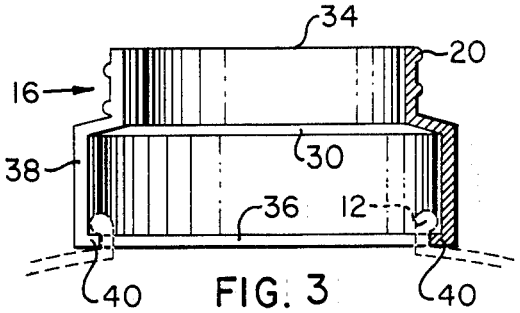
FIG. 3 is a vertical section of the sleeve of FIG. 2 taken through its slot and showing the peripheral rim of the aerosol can in broken lines.

FIG. 3 shows a vertical section of the sleeve 16 taken through the slit 32 and showing one longitudinal slot edge 38. The flange 40 can be seen engaging under the aerosol rim 12 (in broken lines) and defining the bottom opening 36.

To assemble the components of FIG. 2, the sleeve 16 is flexed apart along the slit 32 to extend the flange 40 and enable it to pass over the rim 12, whereupon the outward flexing of the sleeve 16 is stopped and the flange 40 snaps under the rim 12 with the longitudinal edges 38 of the sleeve coming back together. While holding the lower portion 28 of the sleeve in one hand, the cap 22 is screwed tightly onto the sleeve 16 with the other hand. This screwing of the cap 22 onto the screw thread 20 ensures that the edges 38 of the slit 32 cannot flex apart so locking the flange 40 under the rim 12 to securely retain the sleeve in position.

Figure 4:
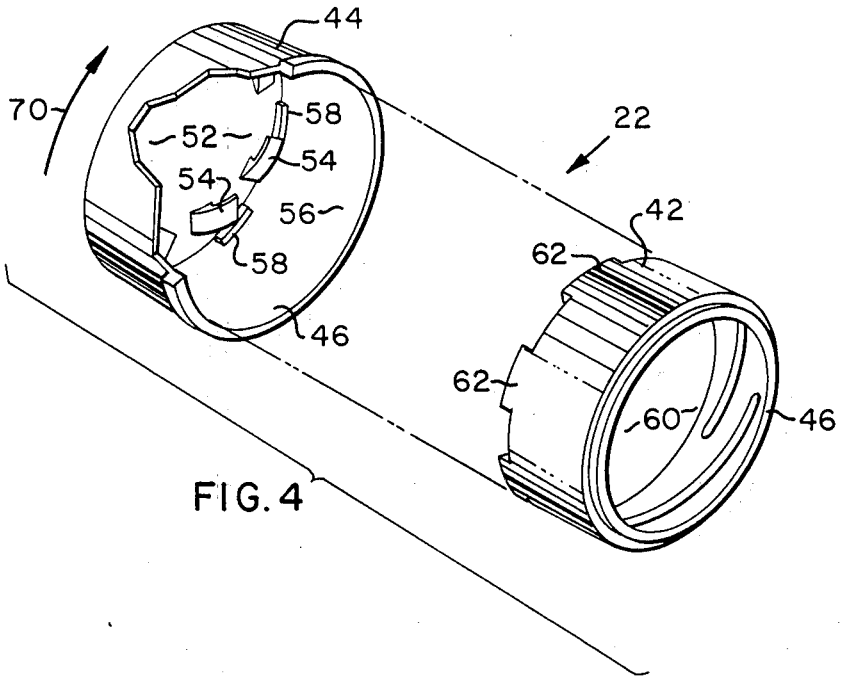
FIG. 4 is an exploded perspective view of the cap of FIGS. 1 and 2.
Figure 5:
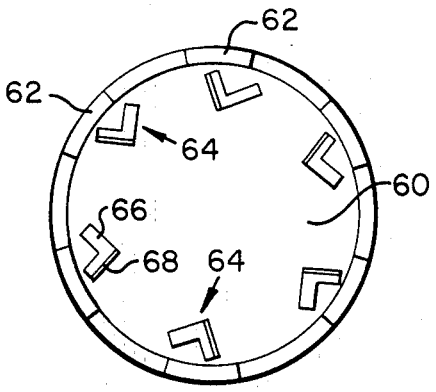
FIG. 5 is a top plan view of the inner member of the cap of FIG. 4.
Figure 6:
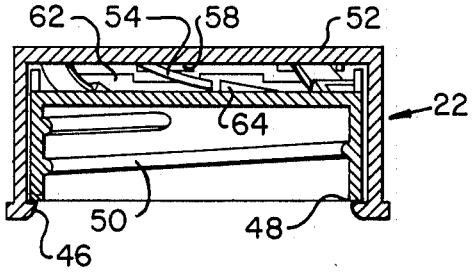
FIG. 6 is a vertical section of the cap of FIG. 4 when assembled.

FIGS. 4, 5 and 6 show further details of the safety cap 22.

FIG. 4 shows in exploded view, partly from below, the safety cap 22 having an inner cap 42 and an outer cap 44, both of which can be molded from thermoplastic material. As is shown in the vertical cross sectional view of FIG. 6, the inner cap is rotatably housed inside the outer cap 44 and is retained therein by a lower, radially inwardly extending flange 46 of the outer cap engaging below the lower edge 48 of the inner cap. The inner cap 42 has an internal screw thread 50 for engagement with the external screw thead 20 on the sleeve 16. On the inside of the top 52 of the outer cap are provided a circle of spaced apart, cantilevered resilient tongues 54. Radially outwardly of the tongues 54, and integral with both the top 54 and sidewall 56 of the outer cap 44 are a series of spaced apart stops 58. Around the periphery of the top 60 of the inner cap 42 are a series of castellations 62. On the top 60, inside the castellations 62, are a series of ratchet teeth 64, the arrangement of which is shown in FIG. 5 and the profile of which can be seen in FIG. 6. Each ratchet tooth 64 has a ramp 66 and a vertical side 68. When the outer cap 44 is rotated in the direction of the arrow 70 in FIG. 4, the cantilevered tongues 54 flex and ride over the ramps 66 of the ratchet teeth 64 so that the outer cap rotates relatively to the inner cap 42 and the latter is not unscrewed from the sleeve 16. If the outer cap 44 is rotated in the opposite direction to the arrow 70, the free ends of the cantilevered tongues 54 engage against the vertical sides 68 of the ramps 66 and cause the inner cap to rotate with the outer cap; thus either screwing the inner cap 42 onto the sleeve 16 or, if already screwed-on, further tightening the inner cap on the sleeve 16. However, if the outer cap 44 is firmly pushed down against the inner cap 42 and simultaneously turned in the direction of the arrow 70, the stops 58 engage between the castellations 62 in dog clutch like manner and cause the inner cap to rotate in unison with the outer cap. In this way the safety cap 22 can be unscrewed and removed from the sleeve 16. For further details of the safety cap 22, reference is made to U.S. Pat. No. 3,857,505.

In use, the aerosol dispenser is stored with the safety cap 22 securely screwed onto the sleeve 16 which in turn has its lower flange 40 firmly engaged and locked under the rim 12 of the aerosol can. If a child tries to remove the safety cap 22 by simply turning the outer cap 44, then the outer cap will either further tighten the inner cap onto the sleeve 16, further rotation then rotating the sleeve 16 on the aerosol can, or the outer cap will rotate relative to the inner cap with a clicking sound as the tongues 54 flex over the ramps of the ratchet teeth 64. In either case the safety closure 22 will not come off regardless of whether or not the lower portion 28 of the sleeve 16 is gripped in one hand. When a trained person wishes to use the aerosol dispenser, the sleeve 16 is gripped in one hand, the outer cap 44 is gripped in the other hand and simultaneously pushed downwardly and rotated in the direction of the arrow 70 until the cap assembly 22 unscrews and disengages from the sleeve 16. The height of the sleeve, which is higher than the valve member 14, still prevents the aerosol spray being directed. Next, the sleeve is flexed outwardly along its slit 32 to enable the sleeve flange 40 to be disengaged from and moved over the aerosol's rim 12. The sleeve 16 can then be placed on a surface with the safety cap assembly 22 and the aersol can is now ready for use by directing the orifice 24 at the target to be sprayed and depressing the valve member 14.

To again store the aerosol dispenser, the sleeve 16 is first snapped onto the aerosol can and then the safety closure again screwed onto the sleeve 16.

It will be appreciated, therefore, that the slit, threaded and flanged sleeve enables known types of child resistant closure caps to be employed with aerosol cans. Such closures are already in mass production so reducing their cost. Further, the adult public is familiar with their mode of operation and has already accepted the credibility of this type of child resistant closure cap. The reduction in diameter of the upper portion 26 of the sleeve enables medicine type closure cap assemblies of normal dimensions for medicine bottles to be readily employed.

It will also be appreciated that the necessity of removing the resilient sleeve is a further safety feature.

The above described embodiment, of course, is not to be construed as limiting the breadth of the present invention. Modifications, and other alternative constructions, will be apparent which are within the spirit of the invention and scope of the appended claims.

What is claimed is:

1. A safety closure for an aerosol can having a peripheral rim, comprising:
   - a split sleeve having top and bottom openings and a continuous slit extending the height of the sleeve between said openings, said slit forming first and second edges in said sleeve;
   - said sleeve having externally thereon a screw thread;
   - said sleeve being normally biased such that the slit is closed and said edges are in contact;
   - an inwardly extending flange at the bottom of said sleeve defining said bottom opening, whereby said flange can engage below the peripheral rim of the aerosol can after said sleeve has been temporarily flexed apart along said slit to enable said flange to pass over said rim;
   - a safety cap having an internal screw thread engageable with said external screw thread to prevent said sleeve from flexing apart along said slit and to lock said flange under said rim; and
   - means, incorporated in said safety cap, for preventing said cap from being simply unscrewed from said sleeve without performing additionally a safety operation.

2. The safety closure of claim 1, wherein the external screw thread is located around an upper portion of said sleeve.

3. The safety closure of claim 2, wherein said upper portion is cylindrical, and said sleeve has a lower cylindrical portion of larger diameter than said upper portion.

4. The safety closure of claim 3, wherein said upper and lower portions are connected by a frusto-conical section.

5. The safety closure of claim 2, wherein said external screw thread is a single continuous screw thread except where interrupted by said slit.

6. The safety closure of claim 5, wherein said sleeve is generally cylindrical with a central axis and said slit is parallel to said central axis.

7. The safety closure of claim 1, wherein said sleeve is molded from thermoplastic material.

8. The safety closure of claim 1, wherein said safety cap comprises an inner cap rotatably mounted in an outer cap, and said preventing means is operative between said inner and outer caps.

9. The safety closure of claim 8, wherein said preventing means comprises abutments on the inside of said outer cap and the outside of said inner cap which only engage when said outer cap is pushed firmly downwards against said inner cap to enable said outer and inner caps to be unscrewed in unison from said sleeve.

10. The safety closure of claim 8, wherein said preventing means comprises a ratchet arrangement which allows said outer cap to rotate relatively to said inner cap in the unscrewing direction of said safety cap unless pressed firmly downwards, but causes said inner cap and said outer cap to rotate in unison in the screwing on direction of said safety cap.

11. The safety closure of claim 1, wherein said safety operation comprises pushing firmly downwardly on said safety cap while unscrewing the latter.

12. A safety closure for an aerosol can having a peripheral rim, said safety closure comprising;

a generally cylindrical split sleeve having a continuous slit in the entire length thereof, said slit being parallel to the lengthwise direction of said sleeve, said slit forming first and second opposing edges;

said sleeve having an upper externally threaded portion;

said sleeve being normally biased such that the slit is closed and said edges are in contact;

a radially inwardly extending flange at the bottom of a lower portion of said sleeve;

a safety cap assembly comprising an outer cap rotatable relative to an inner member, said inner member being internally screw threaded for threadedly engaging said externally threaded portion;

engagement means for allowing said outer cap to rotate said inner member when screwing said safety cap assembly onto said sleeve, but allowing said outer cap to rotate relative to said inner member when trying to unscrew said safetiy cap assembly from said sleeve unless said outer cap is also pushed firmly downwards on said inner member; and whereby in use said flange is engageable below and releasable from said peripheral rim by flexing said sleeve apart along said slit, and when screwed on said sleeve said safety cap assembly prevents said sleeve flexing apart along said slit to lock said flange below said rim.

13. The safety closure of claim 12, wherein said upper portion is integrally connected to said lower portion by a frusto-conical section.

14. An aerosol dispenser, comprising:

an aerosol can having at its top a dispensing valve member extending through a peripheral rim;

an externally threaded split sleeve having a continuous slit extending the length thereof to enable said sleeve to be flexed apart along said slit, said sleeve being normally biased to keep the slit closed;

an inwardly extending flange at a lower end of said sleeve and engaged below said rim;

an internally threaded safety cap threadedly engaged on said externally threaded sleeve and preventing said sleeve from flexing apart along said slit whereby said flange is locked under said rim; and means, incorporated in said safety cap, for preventing said cap from being unscrewed from said sleeve unless said cap is additionally pressed firmly downwards.

15. The aerosol dispenser of claim 14, wherein said sleeve has a central axis and comprises a cylindrical upper portion which is externally screw threaded, a lower coaxial cylindrical portion of larger diameter than said upper portion, and said slit is parallel to said axis.

16. The aerosol dispenser of claim 15, wherein said safety cap comprises an inner member housed within and rotatable relative to an outer cap, and said preventing means is operative between said inner member and said outer cap.

* * * * *